US005787819A

United States Patent [19]

Fumanelli

[11] Patent Number: 5,787,819

[45] Date of Patent: Aug. 4, 1998

[54] ANTI-EFFRACTION DEVICE, IN PARTICULAR FOR AUTOMATIC DISPENSERS OF BANKNOTES AND VALUABLES

[75] Inventor: Giuseppe Ezio Fumanelli, Melzo, Italy

[73] Assignee: M.I.B. Elettronica S.r.l., Peschiera Borromeo, Italy

[21] Appl. No.: 681,951

[22] Filed: Jul. 30, 1996

[51] Int. Cl.[6] ..... E05G 1/00

[52] U.S. Cl. ..... 109/38; 109/31; 109/32; 109/25; 109/56; 70/268; 70/271; 312/319.5

[58] Field of Search ..... 109/25, 29–32, 109/38–44, 63.5, 56; 70/267, 268, 271, 272, 273; 312/319.5

[56] References Cited

U.S. PATENT DOCUMENTS

| | | | |
|---|---|---|---|
| 1,766,560 | 6/1930 | Stockwell | 70/269 |
| 2,140,698 | 12/1938 | Goehring | 70/268 |
| 3,654,880 | 4/1972 | Schesso | 109/25 |
| 4,277,962 | 7/1981 | Lipschutz | 70/423 |
| 4,425,853 | 1/1984 | McGregor et al. | 109/25 |
| 4,649,833 | 3/1987 | Cummins | 109/25 |
| 4,722,435 | 2/1988 | Mareels et al. | 109/25 |
| 4,942,831 | 7/1990 | Tel | 109/25 |
| 5,087,107 | 2/1992 | Fumanelli | 312/319 |
| 5,156,272 | 10/1992 | Bouchard et al. | 109/25 |
| 5,387,903 | 2/1995 | Cutter et al. | 70/271 |
| 5,437,174 | 8/1995 | Aydin | 70/423 |
| 5,537,938 | 7/1996 | Lopez, Jr. | 109/25 |
| 5,555,752 | 9/1996 | Fitzpatrick | 70/278 |
| 5,598,793 | 2/1997 | Lopez, Jr. | 109/25 |

FOREIGN PATENT DOCUMENTS

| | | | |
|---|---|---|---|
| 0113296 | 7/1984 | European Pat. Off. | 70/271 |
| 2478040 | 9/1981 | France | 109/25 |
| 3906808 | 12/1989 | Germany | 109/25 |
| 004201969 | 7/1993 | Germany | 70/269 |
| 80/00887 | 5/1980 | Japan | 109/29 |
| 592230 | 10/1977 | Switzerland | 109/25 |

*Primary Examiner*—Darnell M. Boucher
*Attorney, Agent, or Firm*—Browdy and Neimark

[57] ABSTRACT

An anti-effraction device in particular for automatic dispensers of banknotes and valuables is provided which comprises a casing, a door formed in the casing, and at least one container internal to the casing and adapted to house banknotes and valuables, the anti-effraction device comprising time control members adapted to impose a delay period in the door-opening procedure and detection means adapted to detect the presence of banknotes and valuables in the container and to send the time control members a correction signal substantially depending on the presence of banknotes and valuables, said time control members being at least partly interlocked to said correction signal in a manner adapted to vary the delay period in the presence of the correction signal.

6 Claims, 2 Drawing Sheets

ANTI-EFFRACTION DEVICE, IN PARTICULAR FOR AUTOMATIC DISPENSERS OF BANKNOTES AND VALUABLES

BACKGROUND OF THE INVENTION

The invention relates to an anti-effraction device, in particular for automatic dispensers of banknotes and valuables.

The device also applies to containers, safety cabinets and safes housing banknotes and valuables.

It is known that automatic dispensers of banknotes and valuables only include a light armor plating and therefore in many cases they are provided with specific anti-effraction devices in order to increase their protective level. Said anti-effraction devices carry into effect an active protection, in that they regulate access to the inside of the dispensers and intervene in an active manner, should appropriate sensors detect tampering or lock-picking attempts or opening operations that are not allowed or are not carried out following the prescribed modalities.

Typically, said anti-effraction devices are comprised of control members adapted to impose an adequate delay between an opening command or beginning of an opening operation and the actual final opening, as well as of an atomizer apparatus capable of intervening by spraying coloring and indelible liquids onto banknotes and valuables: stained banknotes and valuables become unusable and therefore any effraction attempt is discouraged.

It is to point out that anti-effraction devices also represent a hindrance when opening attempts are made without lock-picking but at hours beyond the established ones, or at the permitted hours but without complying with all opening procedures, in particular the appropriate delay between starting of opening and final opening.

This expedient is important in order to avoid the staff in charge being obliged to open the dispensers under a threat. Actually, a person carrying into effect a criminal attack usually cannot accept a delay of half an hour or an hour for example.

This situation, while offering important advantages, also has important drawbacks.

In fact, opening of said dispensers is slow and relatively complicated even when this operation is really necessary, when the automatic banknote dispensers are out of banknotes for example, and a new supply is required.

In addition, the authorized staff may happen to carry out wrong procedures, in particular they may not thoroughly respect the opening delay, which will cause activation of the atomizer apparatus.

Typically, the uncomplete observance of the opening delay occurs when operation of an opening key takes place before a given time has elapsed from an initial opening command given by inputting an appropriate combination.

Another drawback in the presently known anti-effraction devices results from the fact that the presence and action of these devices is not particularly manifest: a mere writing signalling the presence of same may not be believed, and therefore may not deter ill-intentioned people from carrying out a pick-locking attempt or an attack to the authorized staff.

SUMMARY OF THE INVENTION

Under this situation the technical task underlying the present invention is to provide an anti-effraction device capable of substantially obviating the above mentioned drawbacks.

The technical task mentioned is substantially achieved by an anti-effraction device, in particular for automatic dispensers of banknotes and valuables comprising a casing, a door formed in said casing, and at least one container within said casing adapted to house banknotes and valuables, the anti-effraction device comprising: time control members adapted to impose a delay period in the opening procedure of said door, and detection means adapted to detect the presence of banknotes and valuables in said at least one container and to send said time control members a correction signal substantially depending on the presence of banknotes and valuables, said time control members being at least partly interlocked to said correction signal in a manner adapted to vary said delay period in the presence of said correction signal.

BRIEF DESCRIPTION OF THE DRAWINGS

The description of a preferred embodiment of the invention is now given, by way of non-limiting example, with the aid of the accompanying drawings, in which.

DETAILED DESCRIPTION OF THE INVENTION

Figure 1:
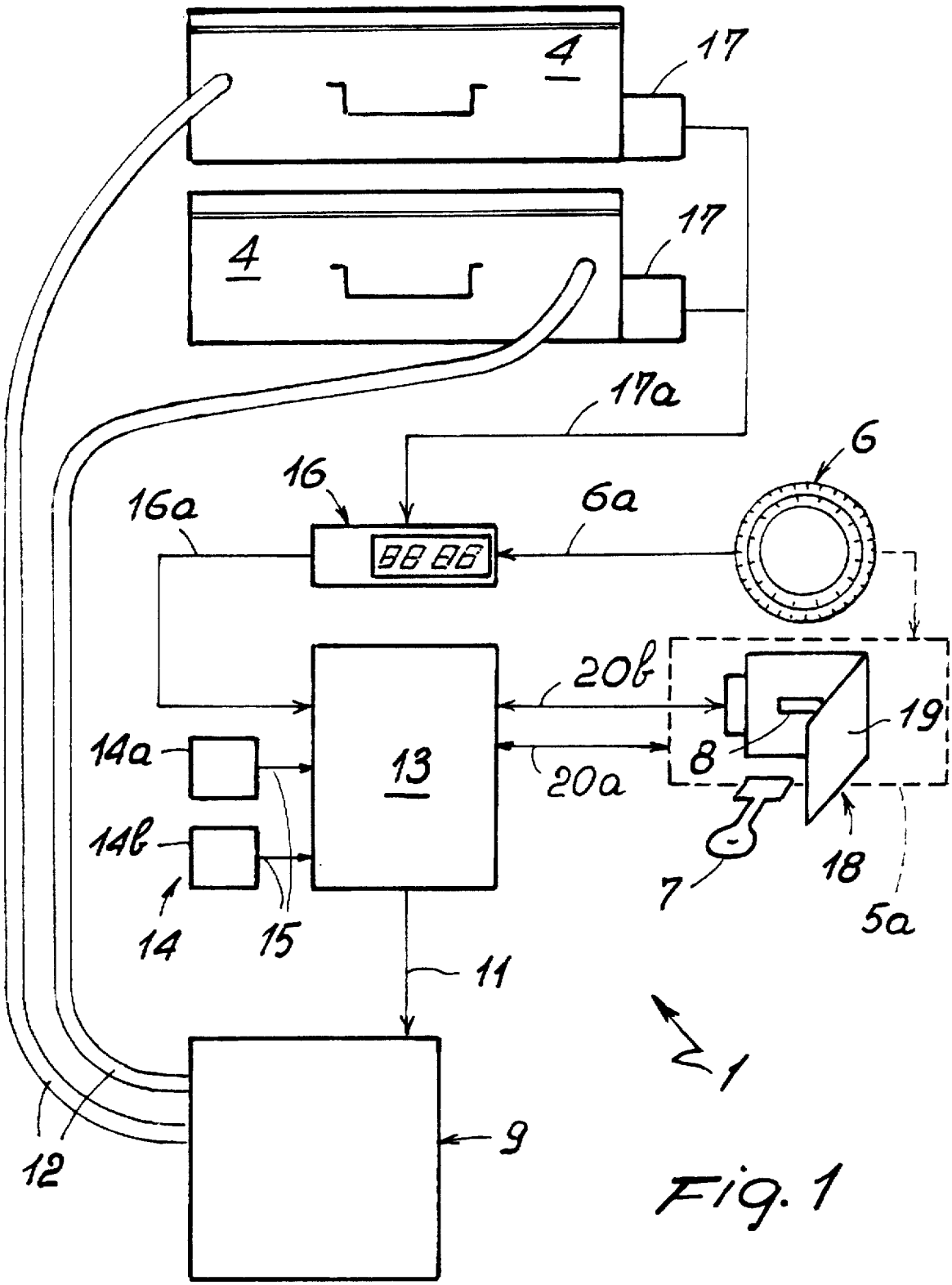
FIG. 1 is a diagrammatic view of an anti-effraction device in accordance with the invention, taken as a whole.

With reference to the drawings, the anti-effraction device in accordance with the invention is generally identified by reference numeral 1.

In the drawings it is shown as applied to a cash dispenser 2 known per se, of the type known as automatic teller or "bancomat", having a casing 3 provided with a light armor plating and inner containers 4 holding the banknotes to be delivered.

Delivery of the required amounts takes place by devices known per se, which are not part of the invention.

Opening of casing 3 occurs at at least one door 5, which is located at the casing back or laterally with respect to the casing area where the devices for dispensing the required amounts are arranged.

The door 5 enables access to containers 4 and can be opened by initial inputting of an appropriate combination at a combiner 6, for example, a combination lock, a keypad, etc. and final activation of a key 7 at a keyhole 8.

The key 7 acts on a closing mechanism **5*a* known per se, located in the door 5**.

Figure 2:
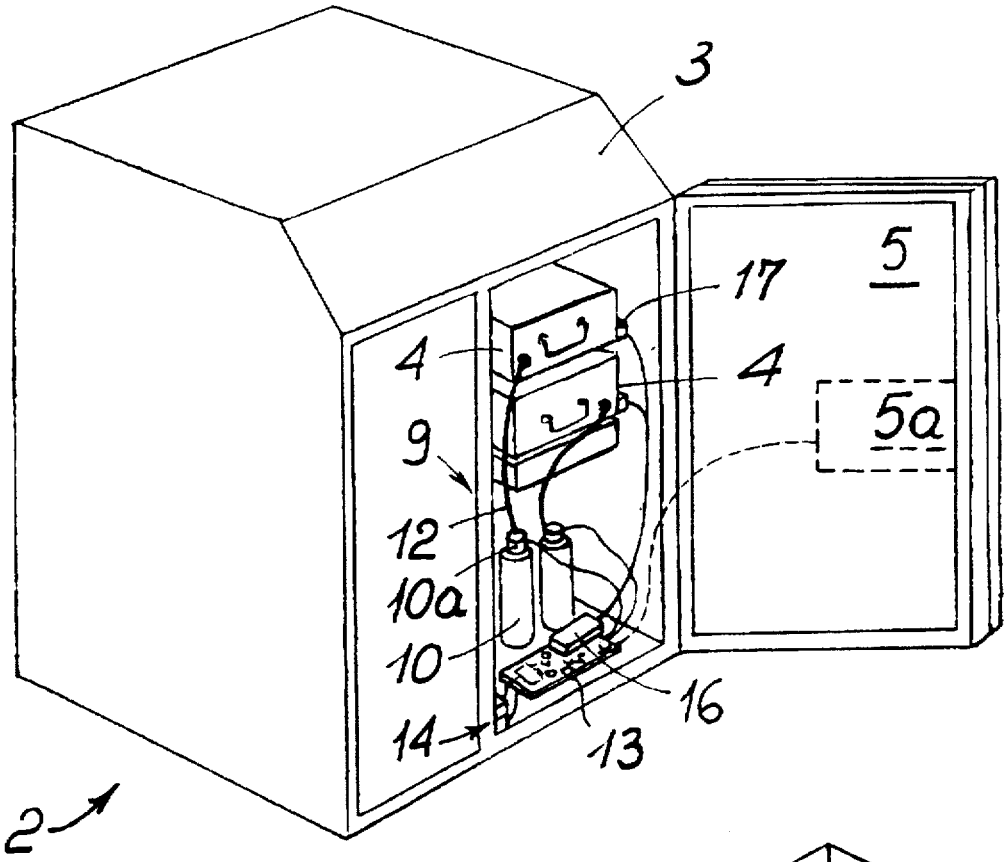
FIG. 2 shows how the members of the device shown in FIG. 1 are introduced into a dispenser known per se.
Figure 3:
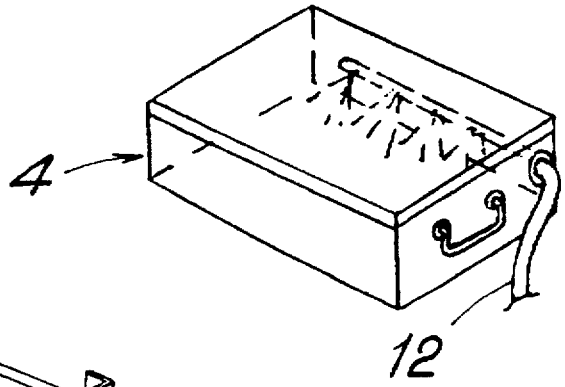
FIG. 3 shows a banknote and valuables container which is located inside the dispenser in FIG. 2, in an isolated view and partly in phantom.

The inventive device 1 has an active-protection apparatus 9 arranged within the casing 3 and preferably embodied by an atomizer apparatus that, as shown in FIG. 2, comprises small aerosol bombs 10, containing a coloring and indelible liquid and provided with delivery valves **10*a* operable by an electrical control signal 11** for carrying out actuation of same.

Bombs 10 are connected by pipes 12 to containers 4, to the inside of which they can spray the coloring liquid. The electrical control signal 11 for actuation is emitted by electronic circuits 13 consisting for example of a board located at the casing 3 base, together with the aerosol bombs 10.

The electronic circuits 13 are connected to sensor members 14 adapted to detect lock-picking attempts and non-permitted operations and to emit alarm signals 15.

For example, first sensor members 14a are provided which are located close to the inner surfaces of casing 3 and adapted to detect perforations and opening of door 5, as well as second sensor members 14b adapted to detect possible displacements of casing 3.

The electronic circuits 13 are connected to time control members 16.

The latter are shown in FIG. 1 and are adapted to emit an enabling signal 16a for door opening only when said opening is requested at given hours.

Above all, the time control members 16 are adapted to insert a delay period before the real and final opening of door 5 by means of key 7.

This delay, of half an hour or an hour for example, can be arranged between the moment at which sending of an opening signal 6a emitted through the combiner 6 takes place and the moment at which the door 5 is really opened by means of key 7.

According to the invention, the time control members 16 are interlocked to detection means 17 disposed inside the casing 3.

The detection means 17 is, for example, embodied either by optical sensors facing the spaces occupied by the banknotes or valuables, or by weight-responsive sensors located under a surface carrying the banknotes or valuables, or by mechanical-contact members, such as feeler pins, engaging the banknotes and having a varying position depending on the amount of banknotes present therein.

At all events, the detection means 17 is connected to the time control members 16 and is arranged so as to emit an electrical correction signal 17a on occurrence, for example, of an optical state, a weight or a mechanical position corresponding to a minimum or zero amount of banknotes and valuables in containers 4.

The correction signal 17a can be an out-of-stock signal or a reduced-stock signal showing that either the containers 4 are out of banknotes and valuables because all banknotes and valuables have already been dispensed, or the remaining stock is insufficient or reduced to a minimum and a new supply is suitable.

In the presence of this correction signal 17a, the delay period is corrected, for example reduced and even cancelled.

In particular, in the case of an out-of-stock signal the time control members 16 immediately emit an enabling signal 16a which is converted by the electronic circuits 13 to an opening pulse 20a directed to the closing mechanism 5a. Due to this opening pulse 20a, the door 5 can be immediately opened by key 7.

Figure 4:
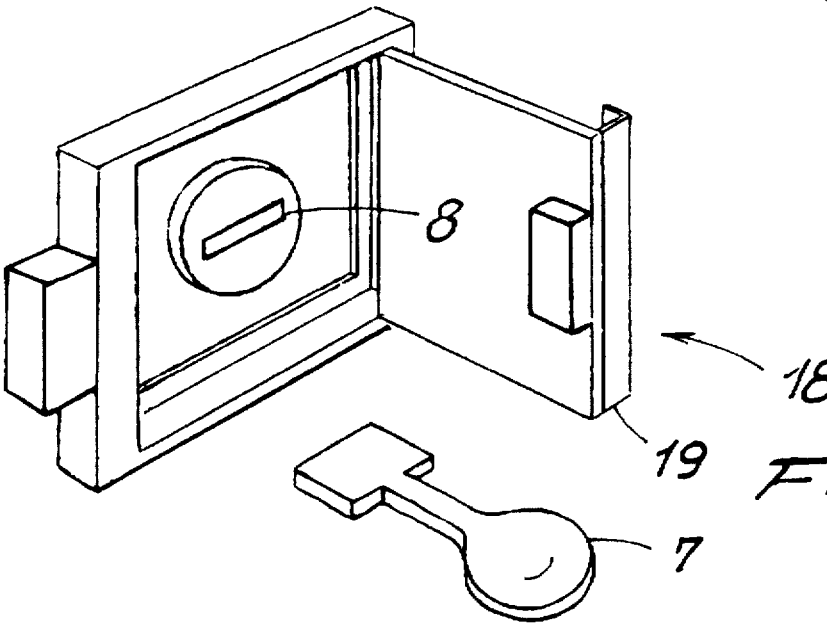
FIG. 4 is a perspective view of an element of the anti-effraction device.

As shown in FIGS. 1 and 4, not only the real opening, but also the mere fitting of key 7 for matching with the closing mechanism 5a is interlocked to the enabling signal 16a. Actually, the device 1 of the invention comprises an external electromechanical blocking element 18 piloted by the control members 16 and the electronic circuits 13 through an auxiliary opening pulse 20b emitted together with the opening pulse 20a.

This blocking element can be embodied by any additional external closing element capable of signalling in a clear manner when opening is not permitted.

In fact, this blocking element aims above all at preventing an erroneous opening of the door 5, before the end of the corrected delay period, therefore highlighting the presence and actual activity of the time control members.

In the embodiment shown the electromechanical blocking element 18 is a keyhole cover provided with a flap or wicket 19 which is, when in the closed position, adapted to prevent introduction of the opening key 17 into the keyhole 8. Operation of the anti-effraction device 1 is as follows. In case of lock-picking attempts the active-protection apparatus 9 begins operating immediately, marking all contents of containers 4 in a clear and ineffaceable manner. In case of opening attempts, which are permitted in themselves but when the containers 4 are not empty, the device imposes a delay in the door opening operation and therefore any possible threat to the authorized staff is made useless.

Unintentional opening errors are excluded because during the delay period the wicket 19 is in a closed position. Advantageously, when containers 4 are empty or almost empty, that is in the typical case in which opening of the door 5 is needed, the delay time is automatically cancelled and therefore opening can take place immediately.

The device puts into practice a process according to which in the dispensers provided with time control members capable of imposing a predetermined delay period in opening, the delay period is also caused to depend on the internal detections conditions of the dispensers.

As a result, the delay period stops being an absolute and uncontrollable element in the inventive device and is regulated in a clever manner, based on detections carried out at the inside of the dispensers, which detections therefore cannot be modified artfully.

By instance, as previously pointed out, the delay period can be cancelled if the dispenser is empty, in addition, it can be cancelled or at least reduced if an inner failure is discovered.

It could even be increased, should the internal operational conditions be judged at risk, when the containers are quite full for example.

In addition, the members imposing the delay period are associated with an externally visible blocking element. Thus these members externally reveal their presence and action and avoid any unintentional error.

The invention achieves important advantages.

In fact, when an empty dispenser needs to be supplied, time losses due to the lapse of time intervening before opening are avoided.

Above all, the delay periods can be regulated in a clever manner without impairing the antitheft capability of the device, since variations are imposed by internal factors. In addition, these anti-effraction devices are capable of offering a true safety to the staff in charge: actually, by blocking access to the key, they highlight the fact that opening without forcings and without making the dispensers' contents useless is impossible.

I claim:

1. An anti-effraction device for automatic dispensers of bank-notes and valuables, comprising:

a casing;

a door for access into said casing;

a closing mechanism for said door;

at least one container within said casing for housing banknotes and valuables;

electronic circuit means for controlling unlocking of said closing mechanism of said door;

detection means inside said casing for detecting operational conditions internally of said casing and for emitting a correction signal depending on said operational conditions;

time control members operatively connected with said electronic circuit means for generating a delay period to cause said electronic circuit means to unlock said closing mechanism upon expiration of said delay period;

said time control members being operatively connected with said detection means emitting said correction signal; and said time control members varying said delay period and generating a corrected delay period in the presence of said correction signal.

2. The anti-effraction device as claimed in claim 1, further comprising sensor means for sensing an opening of said door, and an active-protection apparatus within said casing, said apparatus having means for spraying an indelible coloring liquid onto the banknotes and valuables and being activated by said electronic circuit means when said door is opened before the expiration of said corrected delay period.

3. An anti-effraction device for automatic dispensers of bank-notes and valuables, comprising:

a case;

a door for access into said casing;

a closing mechanism for said door;

at least one container within said casing for housing banknotes and valuables;

electronic circuit means for controlling unlocking of said closing mechanism of said door;

detection means inside said casing for detecting operational conditions internally of said casing and for emitting a correction signal depending on said operational conditions;

time control members operatively connected with said electronic circuit means for generating a delay period to cause said electronic circuit means to unlock said closing mechanism upon expiration of said delay period;

said time control members being operatively connected with said detection means emitting said correction signal;

said time control members varying said delay period and generating a corrected delay period in the presence of said correction signal; and further comprising an electromechanical blocking element associated to said closing mechanism, said blocking element being controlled by said electronic circuit means to prevent actuation of said closing mechanism of said door before the expiration of said corrected delay period and to allow access to said closing mechanism at the expiration of said corrected delay period.

4. The anti-effraction device as claimed in claim 3, wherein said electromechanical blocking element comprises a keyhole cover actuated by said electronic circuit means to prevent insertion of a key into said keyhole before the expiration of said corrected delay period and to allow insertion of said key into said keyhole at the expiration of said corrected delay period.

5. The anti-effraction device as claimed in claim 1, wherein said detection means comprise means for detecting the presence of banknotes and valuables within said at least one container, and wherein said correction signal is an out-of-stock signal emitted by said detection means when said at least one container has a minimum amount of banknotes and valuables, said out-of-stock signal being sent to said time control members and said delay period being substantially canceled in the presence of said out-of-stock signal.

6. The anti-effraction device as claimed in claim 1, further comprising means for highlighting the activation of said time control members and for signalling the expiration of said corrected delay period.

* * * * *